US010107010B2

(12) United States Patent
Gröne et al.

(10) Patent No.: US 10,107,010 B2
(45) Date of Patent: Oct. 23, 2018

(54) LOCK

(71) Applicant: DORMA Deutschland GmbH, Ennepetal (DE)

(72) Inventors: Kai Gröne, Ennepetal (DE); Oliver Gendig, Ennepetal (DE); Peter Marczinzik, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 270 days.

(21) Appl. No.: 15/002,106

(22) Filed: Jan. 20, 2016

(65) Prior Publication Data

US 2016/0333616 A1 Nov. 17, 2016

(30) Foreign Application Priority Data

May 13, 2015 (EP) ..... 15167680

(51) Int. Cl.
*E05B 15/04* (2006.01)
*E05B 65/08* (2006.01)
(Continued)

(52) U.S. Cl.
CPC ..... *E05B 15/04* (2013.01); *E05B 15/0053* (2013.01); *E05B 65/0876* (2013.01); *E05C 1/02* (2013.01); *E05C 1/06* (2013.01); *E05B 2015/0413* (2013.01); *E05B 2015/0472* (2013.01); *E05B 2015/0493* (2013.01)

(58) Field of Classification Search
CPC ..... E05C 1/02; E05C 1/06; E05B 15/0053; E05B 15/04; E05B 63/0017; E05B 65/0876; E05B 2015/0066; E05B 2015/0413; E05B 2015/0472; E05B 2015/0493; Y10T 292/0809; Y10T 292/0834; Y10T 292/096;
(Continued)

(56) References Cited

U.S. PATENT DOCUMENTS 1,472,577 A * 10/1923 Baer ..... E05B 37/0096 70/129
3,774,420 A * 11/1973 Orr ..... E05B 17/2088 292/169.14
(Continued)

FOREIGN PATENT DOCUMENTS

DE 112008000097 T5 11/2009
DE 102013111467 A1 4/2015
(Continued)

*Primary Examiner* — Christine M Mills
(74) *Attorney, Agent, or Firm* — Cantor Colburn LLP

(57) ABSTRACT

A lock includes a housing and a lock mechanism with a dead-bolt disposed in the housing, wherein the dead-bolt is retractable and protrudable between its two terminal positions. The lock further includes at least one bending element disposed in the housing connected to a mechanical component of the lock mechanism at a connecting location, wherein the longest extension of the bending element is defined along a first axis. When the dead-bolt retracts and protrudes, the connecting location of the mechanical component moves along a second axis. The first axis is angled with regard to the second axis, such that when the dead-bolt is displaced into at least one terminal position, the bending element elastically bends and the bending element maintains the lock mechanism in the terminal position.

7 Claims, 6 Drawing Sheets

(51) Int. Cl.
*E05C 1/06* (2006.01)
*E05B 15/00* (2006.01)
*E05C 1/02* (2006.01)

(58) Field of Classification Search
CPC ..... Y10T 292/1014; Y10T 292/102; Y10S 292/24; Y10S 292/44; Y10S 292/61
USPC ..... 292/10, 32, 137, 138, 143, DIG. 24, 292/DIG. 44, DIG. 61
See application file for complete search history.

(56) References Cited

U.S. PATENT DOCUMENTS 3,948,066 A * 4/1976 Solovieff ..... E05B 63/0017 292/139
4,118,056 A * 10/1978 Alexander ..... E05B 59/00 292/169
4,314,217 A * 2/1982 Krasser ..... D06F 37/42 335/168
4,589,691 A * 5/1986 Foshee ..... E05B 63/16 292/150
4,641,865 A * 2/1987 Pastva ..... E05B 63/0069 292/5
5,267,460 A 12/1993 Burleigh
5,681,070 A * 10/1997 Williams ..... E05B 15/04 292/153
6,155,615 A 12/2000 Schultz
6,601,417 B2 * 8/2003 Cowper ..... E05B 9/082 70/129
6,615,627 B2 * 9/2003 Cowper ..... E05B 9/082 70/232
6,722,710 B2 * 4/2004 Cowper ..... E05B 9/082 292/137
6,918,273 B2 * 7/2005 Cowper ..... E05B 9/082 70/129
7,900,979 B2 * 3/2011 Bragg ..... A47L 15/4259 292/137
8,215,135 B2 * 7/2012 Hapke ..... D06F 37/42 134/57 DL
2004/0134239 A1 7/2004 Hapke et al.

FOREIGN PATENT DOCUMENTS

EP 1650380 A1 4/2006
EP 2354386 A1 8/2011
GB 2274134 A 7/1994

* cited by examiner

1

11

11

LOCK

TECHNICAL FIELD

The disclosure relates to a lock with a retractable and protrudable dead-bolt.

BACKGROUND

The disclosure will be explained by way of example based on a so-called multi-lock. Such multi-locks are employed for example in sliding walls. The multi-locks allow for actuating the lock mechanism via at least two actuating elements, for example a frontal actuator and a forehead actuator. Furthermore, a locking cylinder for actuating and/or for interlocking the lock mechanism may be employed. The printed specification DE 10 2013 111 467 A1 reveals a prior-art structure of a multi-lock.

SUMMARY

The present disclosure provides a lock, which, while being inexpensive in manufacturing and having a low-maintenance operation, allows for a reliable functioning of the lock mechanism. In particular, the dead-bolt of the lock should reliably keep its terminal positions.

Disclosure

Thus, the problem is solved with a lock. The lock comprises a housing wherein a lock mechanism is disposed. The lock mechanism in turn comprises a dead-bolt. The housing does not have to be completely closed, but merely serves as an accommodation and as a support for the lock mechanism. The dead-bolt, by means of the further components of the lock mechanism, is retractable and protrudable between its two terminal positions. The lock is for example employed in elements of a sliding wall system. The protruded dead-bolt extends then for example into a corresponding hole in the floor. Moreover, the inventive lock may be employed as well in doors or windows.

At least one bending element is disposed in the housing. The bending element is distinguished in that it has the ability to bent. The bending element is connected to a mechanical component at a connecting location. The mechanical component is an arbitrary mobile part of the lock mechanism. Also the dead-bolt itself may be said mechanical component. A first axis is defined along the longest extension of the bending element. When retracting and protruding the dead-bolt, the connecting location of the mechanical component moves along a second axis. The connecting location may as well move in an arc-shape, wherein the tangent on the arc-shape is defined as the second axis. It is decisive that the first axis be angled with regard to the second axis. In particular the two axes are located vertically to each other. Thereby, when displacing the dead-bolt into at least one terminal position, the bending element elastically bends by means of the movement of the mechanical component.

The elastically bent bending element blocks the mechanical component up to a certain force and thus retains the lock mechanism in the terminal position. Once the bent bending element is returned into its initial position, the lock mechanism can be moved out of the terminal position. In this case, it is in particular intended that the bending element bends during a movement into the two opposite terminal positions of the dead-bolt, and thus the bent bending element immobilizes the lock mechanism in both terminal positions.

The bending element does not require any important actuating neither forces nor any expensive or complicated elements for immobilizing the lock mechanism in the terminal positions. Moreover, the immobilization by means of the bent bending element is independent of any effects of the gravity or potential vibrations.

Advantageously, the bending element is shrinkable along the first axis. The feature "shrinkable" may be as well designated as compressible. Preferably, it is intended that the bending element is a screw spring. In this case, the spring axis of the screw spring corresponds to the first axis. The spring axis is said axis, about which the wire is wound when manufacturing the screw spring. In particular, it is question of a compression spring. The compression spring is installed under pretension in the housing. Said pretension is achieved by compressing the spring along the spring axis.

As an alternative to a screw spring, also a rubber element may be employed as the bending element. The rubber element as well may be installed with pretension (compression along the first axis).

Trials and calculations have proven that a compression spring is very well suited for representing the bending element, because the compression spring is of a relatively small structure and able to bend in both directions.

It is particularly preferred intended that the compression spring presents a spring rate of between 0.3 N/mm and 4 N/mm, preferably between 0.4 N/mm and 2 N/mm, particularly preferred between 0.4 N/mm and 1 N/mm.

Furthermore, it is defined that the bending element has a first length of L1 in the non-installed condition, and in the installed, non-bent condition it has a second length L2. The lengths are measured in this case along the spring axis, respectively along the first axis. Preferably, a pretension value V is defined. The pretension value V is defined as the quotient of the second length L2 and the first length L1 (L2/L1). Advantageously, the pretension value V ranges between 0.9 and 0.3. In particular, it is intended that the pretension value V ranges between 0.8 and 0.4, in particular between 0.7 and 0.5.

Trials and calculations have proven that the above-mentioned ranges for the spring rate F and the pretension value V allow for an appropriate structure of the inventive lock with the bending element. It has proven to be particularly preferred for the configuration of the lock to consider a bending value K. The bending value K is defined as the quotient of the spring rate F and the pretension value V(F/V). Advantageously, the bending value K ranges between 0.25 and 15, preferably between 0.5 and 10, and particularly preferred between 0.5 and 5. The unit of the bending value K is N/mm.

Preferably, the connecting location at the mechanical component is configured as a through-hole. Advantageously, the bending element extends through a through-hole in the mechanical component. On both sides of the through-hole, the two ends of the bending element are advantageously affixed at the housing. As an alternative, it is also possible to connect the two ends of the bending element to further components of the lock mechanism, wherein it needs then to be ensured that a relative movement between the connecting location with the mechanical component and the affixed ends of the bending element is realized.

As an alternative to guiding the bending element through a through-hole in the mechanical component, it is preferably intended to affix one end of the bending element to the mechanical component at the connecting location. The other end of the bending element is affixed to the housing or to another component of the lock mechanism.

Preferably, the mechanical component includes a lever, in particular a knee lever, which is directly rotatably movable connected to the dead-bolt.

The lock is in particular configured as a multi-lock. The multi-lock is in particular employed with sliding wall systems. The multi-lock is defined in that at least two actuating elements are provided for moving and/or for interlocking the lock mechanism. In particular, a reception is provided for a frontal actuation, for a forehead actuation and for a locking cylinder.

BRIEF DESCRIPTION OF THE DRAWINGS

The disclosure will now be described in more detail, reference being made to one embodiment. In the drawings.

DETAILED DESCRIPTION OF THE DRAWINGS

In the following, an exemplary embodiment of a lock 1 will be described based on the FIGS. 1 to 6. The lock 1 is configured as a multi-lock and employed e.g. in sliding wall systems.

Figure 1:
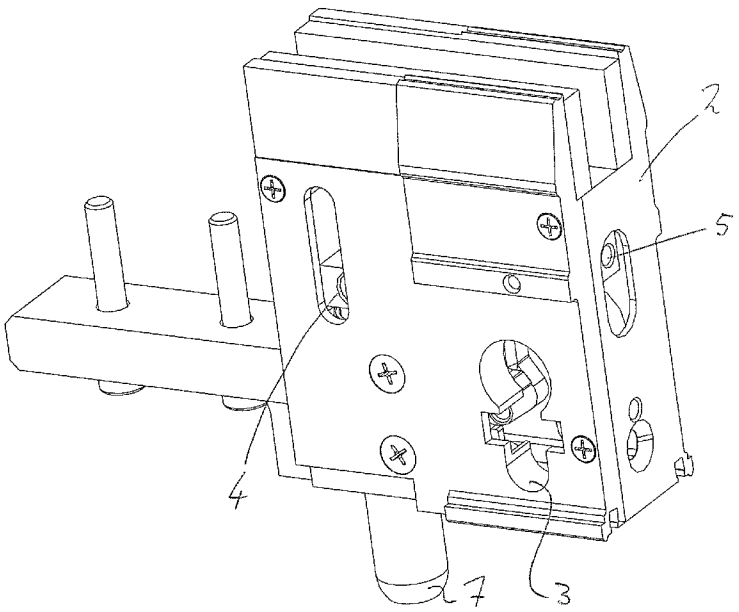
FIG. 1 shows an inventive lock according to an exemplary embodiment in a perspective view.

FIG. 1 shows a multi-part housing 2 of the lock 1. In the FIGS. 2 and 3, a part of the housing 2, which may be also referred to as a cover, is omitted.

Figure 2:
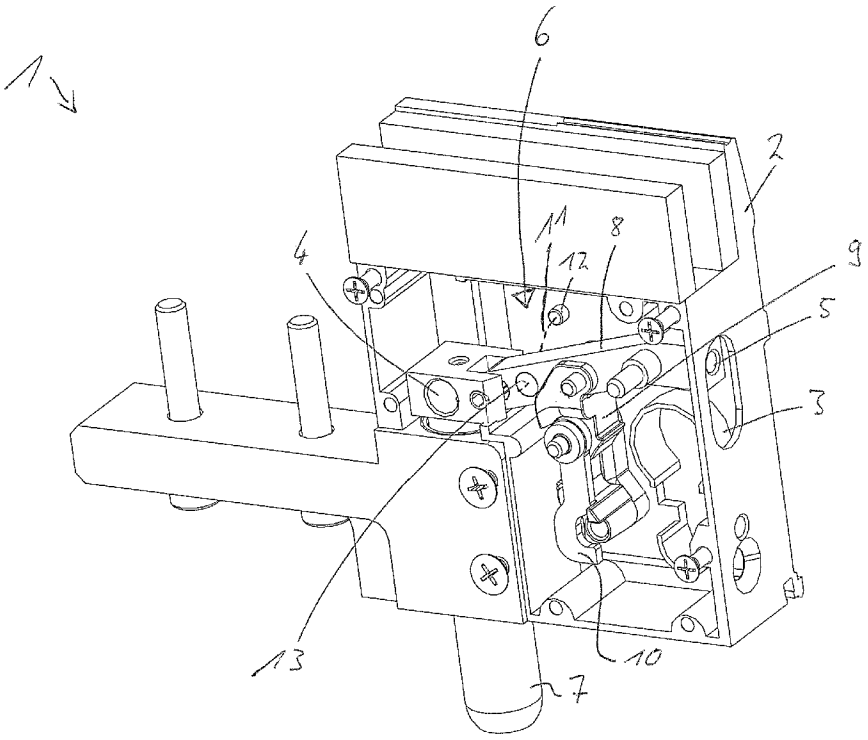
FIG. 2 shows the inventive lock according to the exemplary embodiment with the housing being partially omitted in the perspective view.
Figure 3:
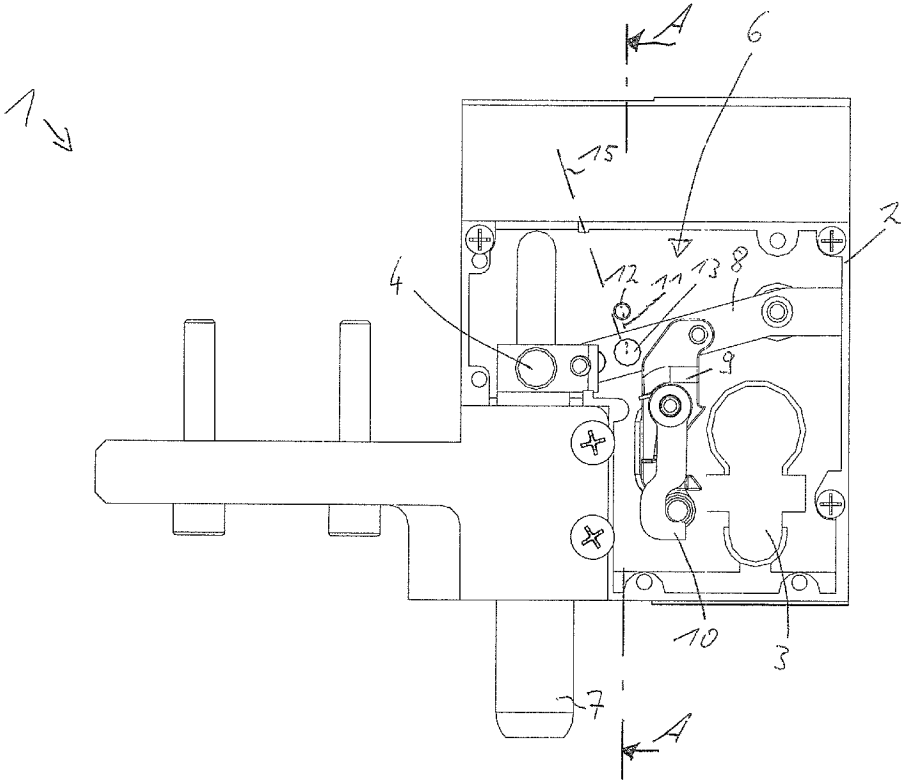
FIG. 3 shows a top view of FIG. 2.

According to the FIGS. 1, 2 and 3, the lock 1 comprises a lock mechanism 6 disposed in the housing 2. A dead-bolt 7 is a component of said lock mechanism 6. The dead-bolt can be retracted and protruded by means of said lock mechanism 6. In the exemplary embodiment shown, the lock 1 is disposed in an element of the sliding wall system.

The protruded dead-bolt 7 projects for example into the ceiling or into the floor and thus immobilizes the individual sliding wall element.

Herein generally, in particular the lever 8 is referred to as a "mechanical component". Said component is very well suited for cooperating with a bending element 11. As an alternative, the dead-bolt 7 may e.g. directly cooperate with the bending element 11.

For actuating and/or for interlocking the lock mechanism 6, a locking cylinder reception 3, a frontal actuating reception 4 and a forehead actuation reception 5 are provided.

The dead-bolt 7 is rotatably movable connected to the lever 8. A tumbler element 9 is attached to the lever 8. Said tumbler element 9 cooperates with a blocking lever 10. The blocking lever 10 can be interlocked in the locking cylinder reception 3 by means of a non-illustrated locking cylinder. Thereby, a movement of the lock mechanism 6 and thus of the dead-bolt 7 is prevented.

The frontal actuation reception 4 is configured at the upper end of the dead-bolt 7. An element, which is inserted here, can be moved upwards and downwards for manually protruding and retracting the dead-bolt 7. The forehead actuation reception 5 allows for actuating the lever 8 via the frontal side of the lock 1.

Figure 4:
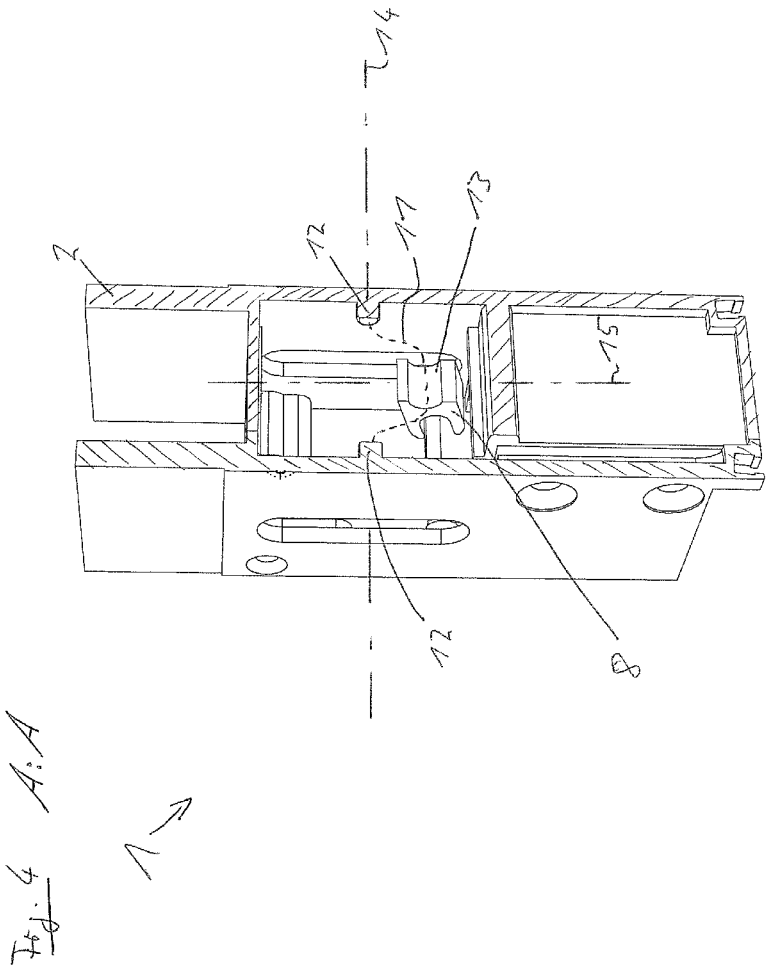
FIG. 4 shows the section A:A in a perspective view.
Figure 5A:
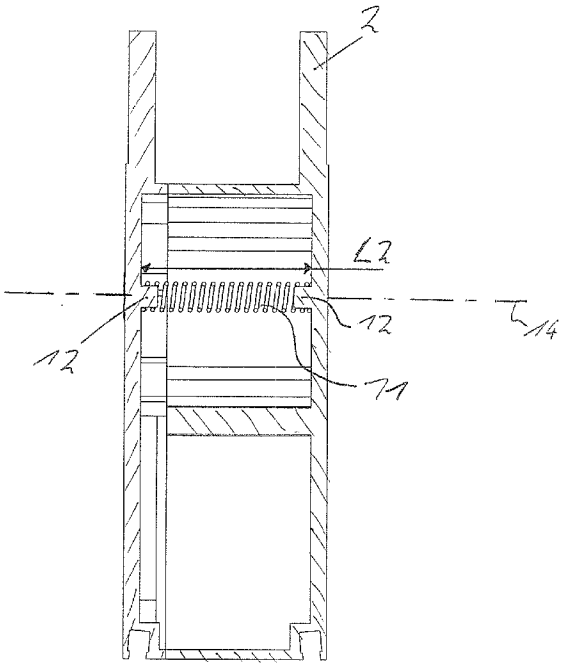
FIG. 5 shows the section A:A in a top view.
Figure 6:
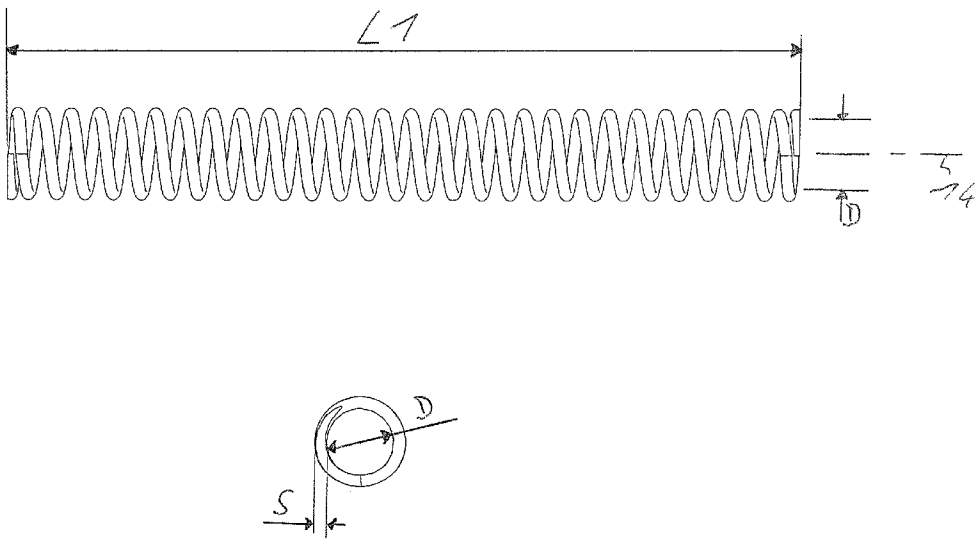
FIG. 6 shows the bending element for the lock according to the exemplary embodiment.

The FIGS. 4 and 5 show the section A:A identified in FIG. 3. The bending element 11 is just diagrammatically indicated by means of a dashed line in FIGS. 2, 3 and 4. FIGS. 5 and 6 show the proper configuration of the bending element 11 as a compression spring.

In the illustrated exemplary embodiment, the bending element 11 is located between the two wallings of the housing 2. In this case, the bending element 11 with its two ends is respectively fitted onto a tenon 12. The tenons 12 are integral components of the housing 2 and serve as a support for the bending element 11.

A connecting location 13 is configured in the lever 8. Herein, the connecting location 13 is a through-hole. The bending element 11 extends through the connecting location 13.

The Figures show a first axis 14. The first axis 14 corresponds to the extension of the bending element 11 in its resting position.

As can be seen for example in FIG. 3, the connecting location 13 moves along a circular path, when the dead-bolt 7 is retracted and protruded. A second axis 15 is defined tangentially with regard to the circular path. The second axis 15 is angled with regard to the first axis 14. In particular, the two axes 14, 15 are located vertically to each other. Thereby, it is guaranteed that the bending element 11 bends during a movement of the lock mechanism 6 into the two terminal positions. In the bent condition, the bending element 11 keeps the lock mechanism 6 in its respective terminal position. Only when exerting the corresponding force, it is possible to move the bending element 11 back into its initial position.

FIG. 6 shows the bending element 11, configured as a compression spring, in its non-installed condition. In this case, the bending element 11 has a length L1. According to FIG. 5, in the installed, non-bent condition, the length of the bending element is L2. The internal diameter of the bending element 11 is identified with D. The thickness of the wire is S.

Trials and calculations have resulted in the following advantageous values, ranges and magnitudes for the bending element 11:

Advantageously, the wire thickness S ranges between 0.2 and 2 mm, particularly preferred between 0.3 and 1 mm. The number of the elastical windings is described with n. Advantageously, n ranges between 10 and 50, particularly preferred between 15 and 35. Advantageously, the material of the bending element 11 is steel with a carbon content of 0.4 to 0.8%, particularly preferred with a carbon content of 0.5 to 0.7%.

The invention claimed is:

1. A lock, comprising:

a housing, a lock mechanism with a dead-bolt disposed in the housing, wherein the dead-bolt is retractable and protrudable between a first terminal position and a second terminal positions by means of the lock mechanism, a bending element is disposed in the housing, wherein the bending element is connected to a mechanical component of the lock mechanism at a connecting location, wherein the longest extension of the bending element is defined along a first axis, wherein, when retracting and protruding the dead-bolt, the connecting location of the mechanical component moves along a second axis, wherein the first axis is angled with regard to the second axis such that when displacing the dead-bolt into at least one of the first terminal position and the second terminal position, the bending element elastically bends and thereby maintains the lock mechanism in the first terminal position or the second terminal position, wherein the bending element includes a screw spring having a spring axis, wherein the spring axis corresponds to the first axis, wherein the connecting location is configured as a through-hole and the bending element extends through the through-hole, and wherein the mechanical component is a lever rotatably movable connected to the dead-bolt.

2. The lock according to claim 1, wherein the bending element is configured as a compression spring and is installed under pretension in the housing.

3. The lock according to claim 2, wherein the compression spring presents a spring rate between 0.3 N/mm and 4 N/mm.

4. The lock according to claim 2, wherein, in a non-installed condition, the bending element has a first length L1 and in an installed, non-bent condition, the bending element has a second length L2, wherein a pretension value is defined as a quotient (L2/L1) of L2 and L1, wherein the pretension value ranges between 0.3 and 0.9.

5. The lock according to claim 1, wherein the bending element is at least partially made of rubber.

6. The lock according to claim 1, wherein one end of the bending element is connected to the mechanical component at the connecting location.

7. The lock according to claim 1, configured as a multi-lock comprising at least two actuating elements for displacing and/or interlocking the lock mechanism.

* * * * *